US005586966A

United States Patent [19]

Wood

[11] Patent Number: 5,586,966

[45] Date of Patent: Dec. 24, 1996

[54] APPARATUS AND METHOD FOR SEPARATING SOLID/FLUID MIXTURES

[75] Inventor: Warwick N. Wood, Cheltenham, Australia

[73] Assignee: Warman International Limited, Artarmon, Australia

[21] Appl. No.: 616,934

[22] Filed: Mar. 18, 1996

Related U.S. Application Data

[63] Continuation of Ser. No. 307,777, filed as PCT/AU93/00159, Apr. 8, 1993 published as WO93/20946, Oct. 28, 1993, abandoned.

[30] Foreign Application Priority Data

Apr. 10, 1992 [AU] Australia ..... PL1857

[51] Int. Cl.[6] ..... B04B 1/20

[52] U.S. Cl. ..... 494/37; 494/53

[58] Field of Search ..... 494/22, 37, 43, 494/50–56; 210/380.1, 380.3, 381

[56] References Cited

U.S. PATENT DOCUMENTS

| | | | |
|---|---|---|---|
| 2,578,456 | 12/1951 | Smith | 494/53 X |
| 2,743,865 | 5/1956 | Graae | 494/52 X |
| 3,685,721 | 8/1972 | Kohama | 494/51 X |
| 3,784,091 | 1/1974 | Hiller . | |
| 3,802,621 | 4/1974 | Merzenich . | |
| 3,861,584 | 1/1975 | Dudrey . | |
| 4,162,978 | 7/1979 | Lidman et al. . | |
| 4,332,349 | 6/1982 | Dietrich et al. . | |
| 4,898,571 | 2/1990 | Epper et al. | 494/55 X |

*Primary Examiner*—Charles E. Cooley

*Attorney, Agent, or Firm*—Jacobson, Price, Holman & Stern, PLLC

[57] ABSTRACT

Material separating apparatus comprising a rotatable main body (13) and a rotatable rotor (14) disposed within the main body. The rotor 14 comprises first and second end walls (16, 17) spaced apart from one another with a rotor chamber therebetween, with a plurality of generally radially extending blades (18) extending between the first and second end walls thereby separating the rotor chamber into a plurality of sub-chambers. A feed inlet chamber is disposed between the main body and the first end wall. The end walls have a circumferential clearance for permitting the flow of material into and the discharge of the heavier component out of the rotor chamber. A generally centrally disposed discharge is in communication with the rotor chamber for discharging the lighter component from the rotor chamber.

12 Claims, 8 Drawing Sheets

(PRIOR ART)

APPARATUS AND METHOD FOR SEPARATING SOLID/FLUID MIXTURES

This is a Continuation of application Ser. No. 08/307,777, filed as PCT/AU93/00159, Apr. 8, 1993 published as WO93/20946, Oct. 28, 1993 which was abandoned upon the filing hereof.

BACKGROUND OF THE INVENTION

The present invention relates to an apparatus for separating materials such as a thickening or dewatering apparatus and to a method of separating, thickening or dewatering a solids/liquid mixture, such as a slurry.

Many industries such as mining, water treatment and pollution control produce slurries which need to be thickened or dewatered for either further treatment or disposal as waste.

Dewatering of slurries can be divided up into three types of processes. These are as follows:

gravity separation; mechanical using vacuum, pressure filters and centrifuges; and thermal.

Each increasing level of dewatering result in a higher unit cost of solids treated.

Conventionally slurries are thickened in large circular thickener tanks (see FIG. 1) where the solids are introduced so as to provide a "top entry" path A and allowed to settle by gravity, often with the use of flocculating agents, to the bottom of the tank where they are withdrawn, with the clarified fluids being drawn off the surface periphery usually by surface weirs.

A development of this process has occurred over the past two decades with the utilization of a sludge blanket or submerged feed entry A into the thickener (see FIG. 2).

This process has increased in utilization by the recent development of high molecular weight flocculants, which have resulted in the reduction of up to 75% in the surface area of the thickener.

These treated slurries can then be fed to more expensive treatment devices such as centrifuges, filtration means or thermal means. However, because of cost limitations some slurries are only treated by gravity means.

Centrifuges are generally as shown in FIG. 3. Normally, flocculated feed is introduced into the centrifuge (1), by a "top entry" path (2) through a region of high shear. This region of high shear requires high usage of flocculant at considerable expense. Top entry of the feed, as in conventional thickeners, utilizes none of the sludge blanket effect and hence, as in conventional tank thickeners, requires a larger residence time to achieve the required results.

Current centrifuges (1) are primarily designed to process solids, with little consideration being given to the flow of the liquor or centrate, which is required to follow a very convoluted path through the scroll (3) to the liquid outlet (4) in the form of a weir (5). This system results in increased turbulence and interaction between the centrate and the settled solids; relying on the high centrifugal forces created by the machine to produce acceptable separation.

SUMMARY OF THE INVENTION

The present invention seeks to alleviate one or more of the aforementioned disadvantages.

According to one aspect of the present invention there is provided an apparatus for separating materials into a heavier component and a lighter component comprising:

a main body a rotor disposed within said main body, said rotor and said main body being rotatable about axes of rotation; said rotor comprising:

first and second end walls spaced apart from one another with a rotor chamber therebetween, and a plurality of generally radially extending blades extending between said first and second end walls and separating said rotor chamber into a plurality of sub-chambers;

a feed inlet chamber between said main body and said first end wall;

said first and second end walls having a circumferential clearance for permitting the flow of material into and the discharge of the heavier component out of the rotor chamber; and a generally centrally disposed discharge in communication with the rotor chamber for discharging the lighter component from the rotor chamber.

The apparatus may further include transfer means for enabling flow of material through the rotor chamber.

In one form the rotor and the main body are caused to rotate at different speeds and the transfer means may comprise a generally helically or spirally shaped strip or band operatively connected to either the rotor or the main body so that relative rotation between the rotor and main body causes transfer of the material by the strip through the rotor chamber.

Preferably, the flow of the lighter and heavier components is co-current.

The main body may, in one form, comprise a generally cylindrically shaped member mounted for rotation with the rotor being co-axially disposed therein and capable of relative rotation thereto.

A feed inlet for delivering material to the feed inlet chamber may be provided with the feed inlet being centrally disposed with respect to the feed inlet chamber. Preferably, the feed inlet chamber includes a plurality of generally radially extending blades therein mounted for rotation within the feed inlet chamber.

The apparatus may further include an outlet chamber between the second end wall of the rotor and the main body and a discharge outlet pipe having its open end disposed towards the periphery of the outlet chamber for discharging the heavier component from the apparatus. In one preferred form a discharge orifice is provided in a partition wall within the outlet chamber between the second end wall and the discharge pipe, the partition wall being mounted for rotation with the main body.

According to another aspect of the present invention there is provided a method of separating material into a heavier component and a lighter component the method comprising the steps of:

feeding material to a rotatable rotor which forms a series of sub-chambers;

causing rotation of the rotor to separate material within the sub-chambers into lighter and heavier components;

transferring the heavier component through the sub-chambers from an inlet end to an outlet end; and discharging the lighter and heavier components from the sub-chambers.

According to yet another aspect of the present invention there is provided an external barrel; and a rotor adapted to rotate about an axis of rotation within said barrel; wherein said rotor comprises:

a first radially extending disc;

a second radially extending disc located axially remote from said first radially extending disc; and a plurality of substantially radially extending blades extending longitudinally between said first and second discs, said rotor and said external barrel defining a feed inlet chamber between said first disc and a first end of said barrel, and a thickening chamber between said first and second discs and wherein said discs each have a circumferential clearance to allow, in use, flow from said feed inlet chamber to said thickening chamber and flow of thickened solids from said thickening chamber to be discharged external of the thickening device, said second disc having a central discharge in communication with said thickening chamber to convey centrate external of the thickening device.

In yet another form the invention comprises a method of thickening or dewatering solids, comprising the steps of:

rotating, about an axis of rotation within a chamber having a feed end and an axially displaced discharge end, a rotor, said rotor comprising substantially radial blades extending substantially axially therealong between said inlet end and said outlet end;

feeding a slurry to be thickened or dewatered around the periphery of said rotor at the feed end of said chamber into a sludge blanket formed in said chamber by the rotation of said rotor; and causing said thickened or dewatered slurry to travel from said feed end to said discharge end along or adjacent the circumference of said rotor, to be discharged from said chamber adjacent the circumference of said rotor, while said liquor separated from said thickened or dewatered slurry discharges from a central axially located outlet in said discharge end of said chamber.

BRIEF DESCRIPTION OF THE DRAWING

Preferred embodiments of the present invention will now be described with reference to the accompanying figures in which.

DESCRIPTION OF THE PREFERRED EMBODIMENTS

The apparatus and method according to a preferred form of the present invention utilizes the advantages of applying higher than gravity forces in combination with sludge blanket (submerged feed entry) technology to the thickening, separation and classification of slurries in individual chambers, all of which are rotating.

Figure 4:
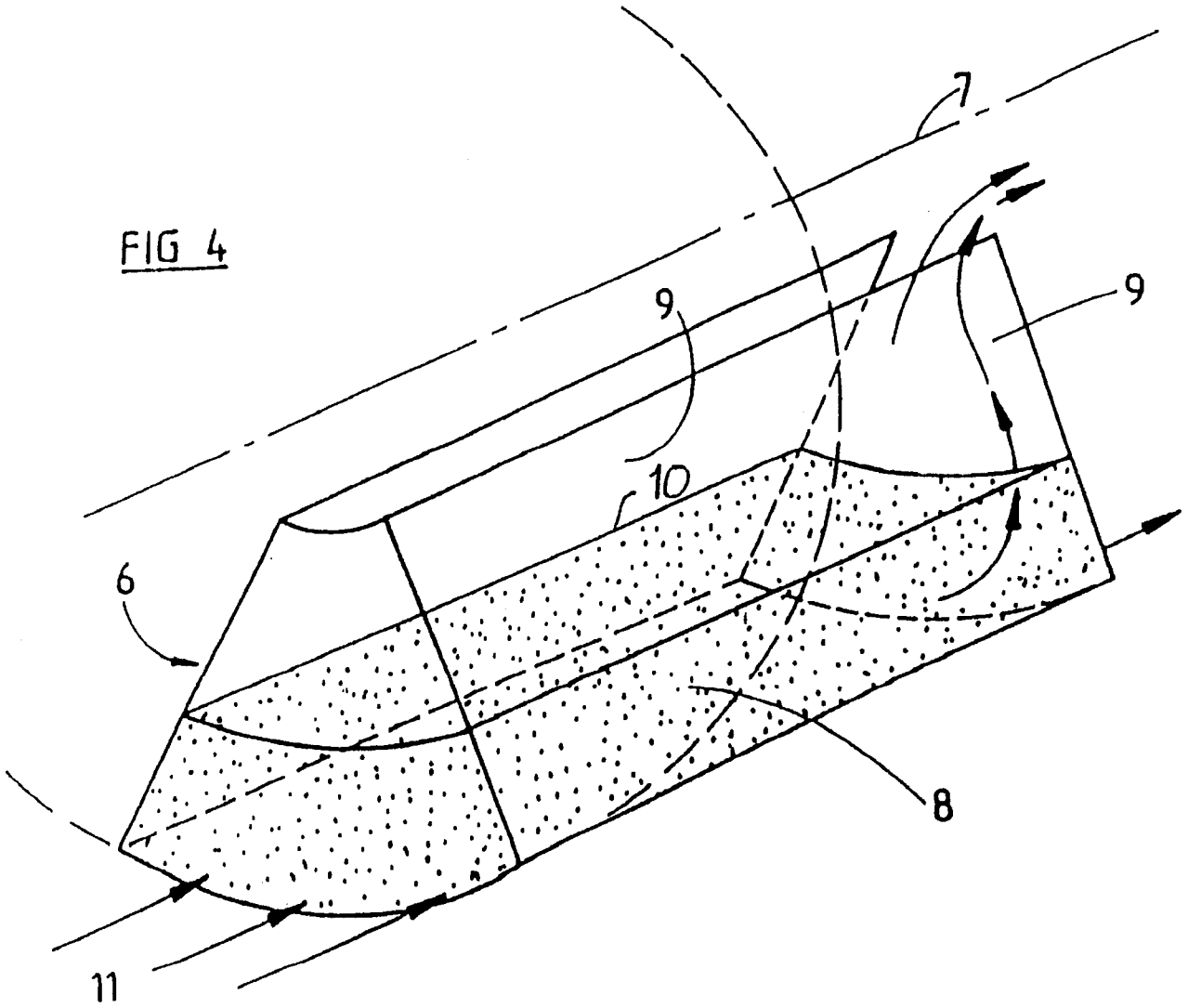
FIG. 4 illustrates schematically the concept of the present invention.

The concept of the present invention is shown in FIG. 4 in which a segment of slurry (6) flocculant treated or otherwise is rotated about the axis (7) producing a centrifugal force which separates the thickened solids from the clarified liquid (9) forming a sludge blanket having a distinct interface (10) therebetween. The feed (11) is fed into the sludge blanket (8) at the periphery of the segment (6). The solids are compacted by the centrifugal force and the liquor (9) percolates towards the axis of rotation (7) where it is discharged. The thickened or compacted solids are moved along the circumference (outside) of the segment, to be discharged.

Figure 5:
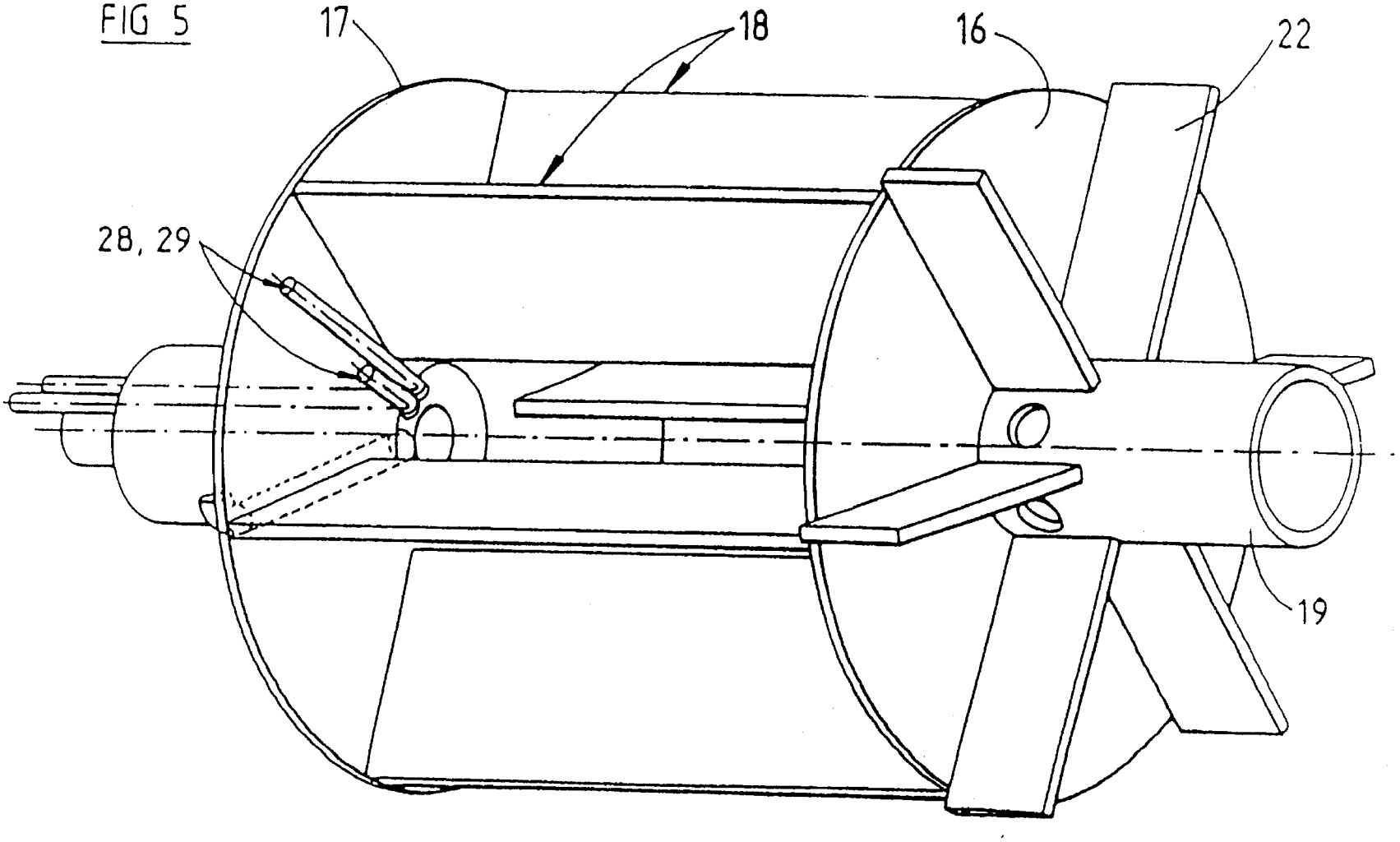
FIG. 5 illustrates one form of a rotor in accordance with one embodiment of the present invention.
Figure 6:
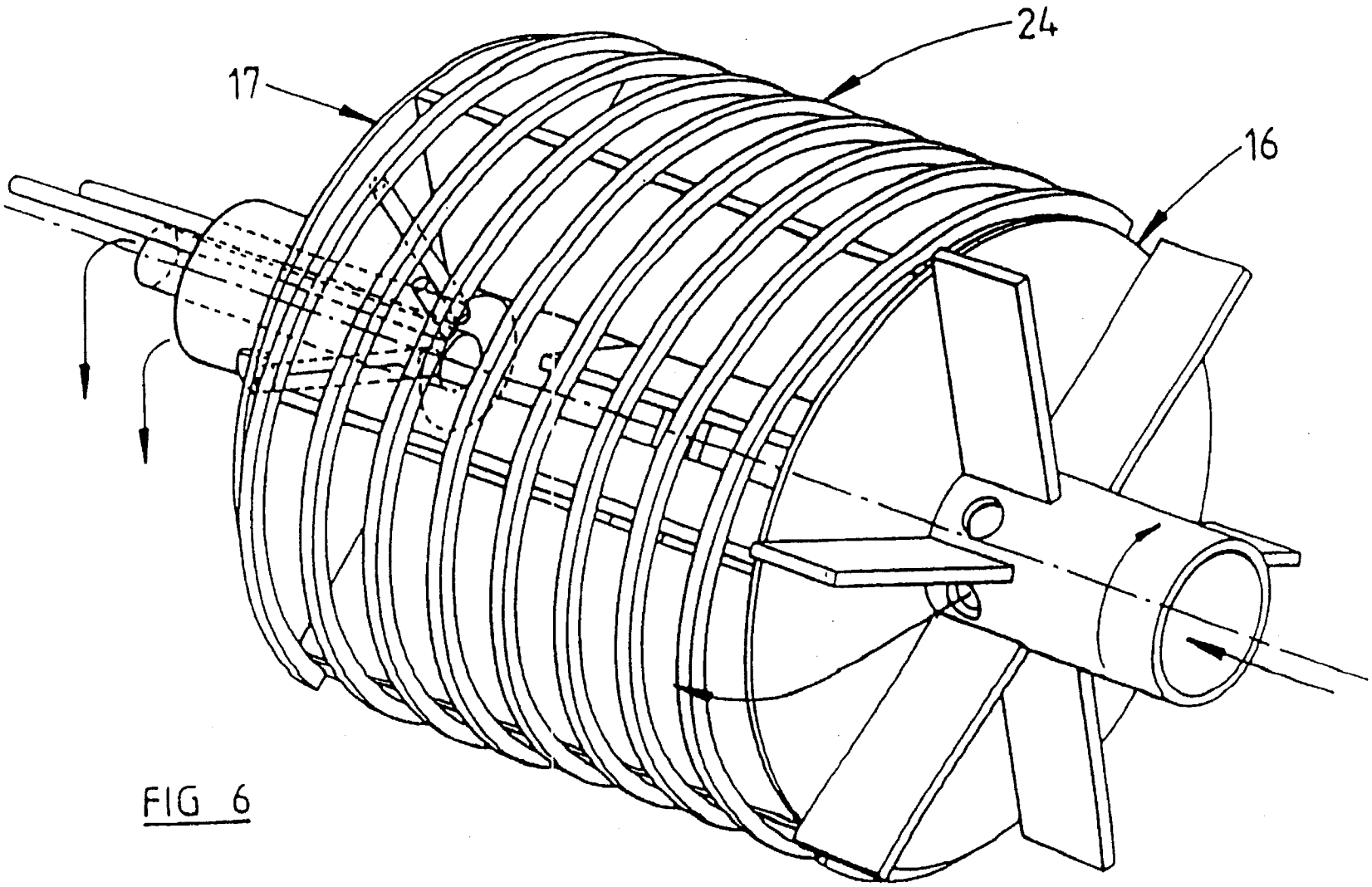
FIG. 6 illustrates the rotor of FIG. 5 with a ribbon scroll affixed thereto.
Figure 7:
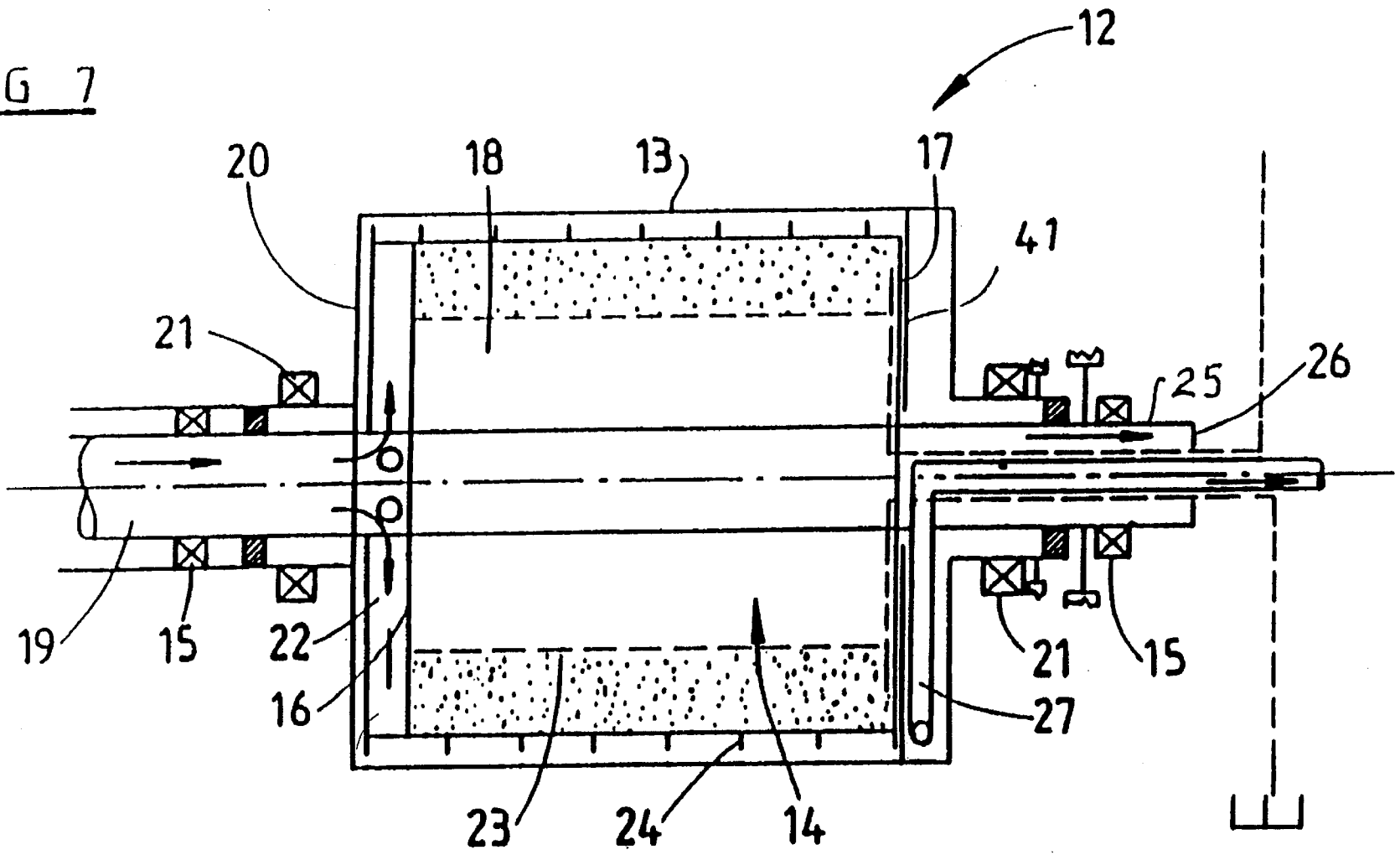
FIG. 7 illustrates, in a schematic cut-away, one embodiment of the present invention.
Figure 9:
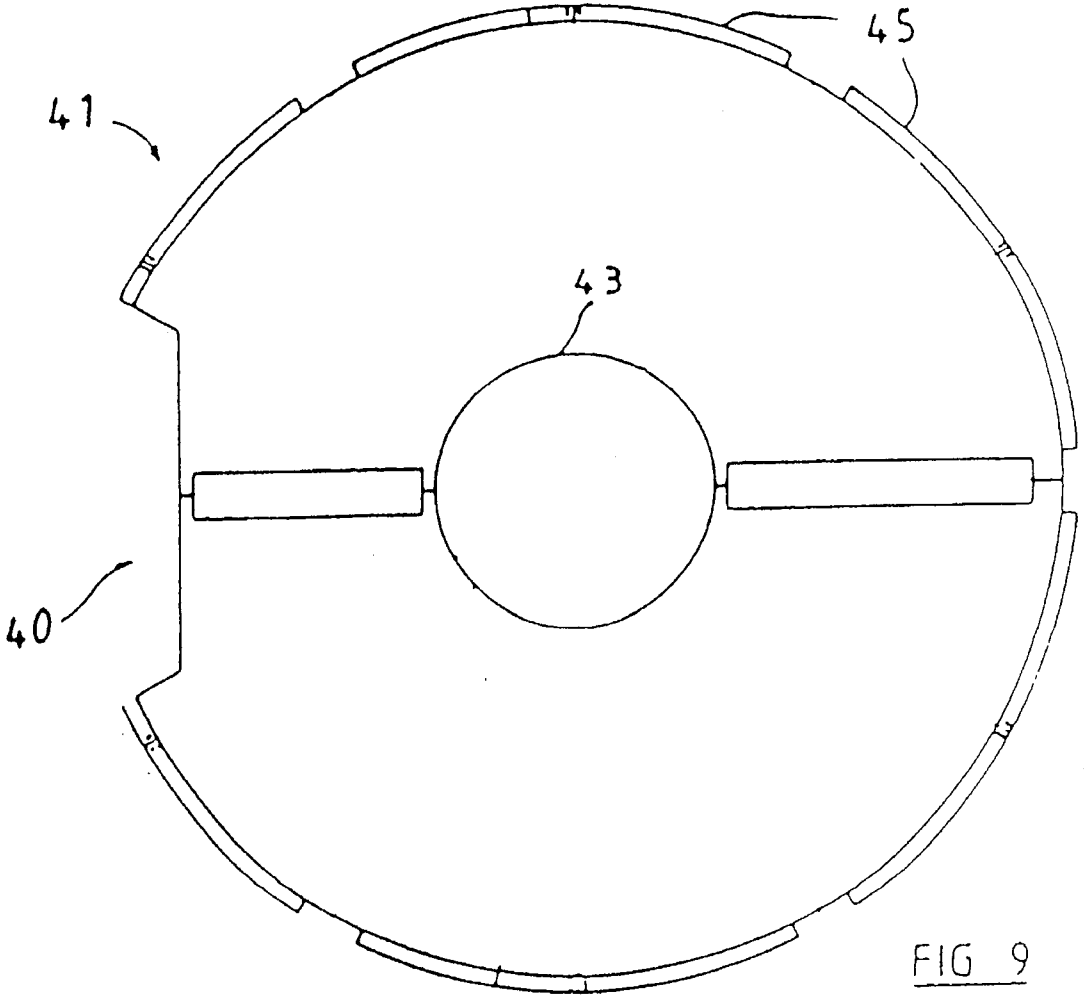
FIG. 9 is a front elevation of the partition wall shown in FIG. 8.
Figure 8:
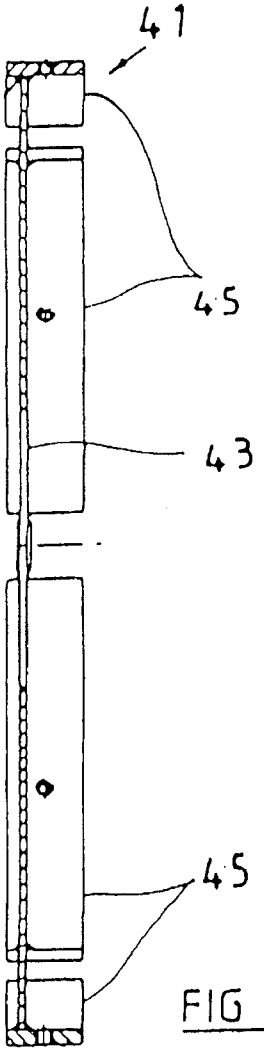
FIG. 8 is a sectional side elevation of a partition wall having a discharge orifice therein which forms part of the apparatus.
Figure 10:
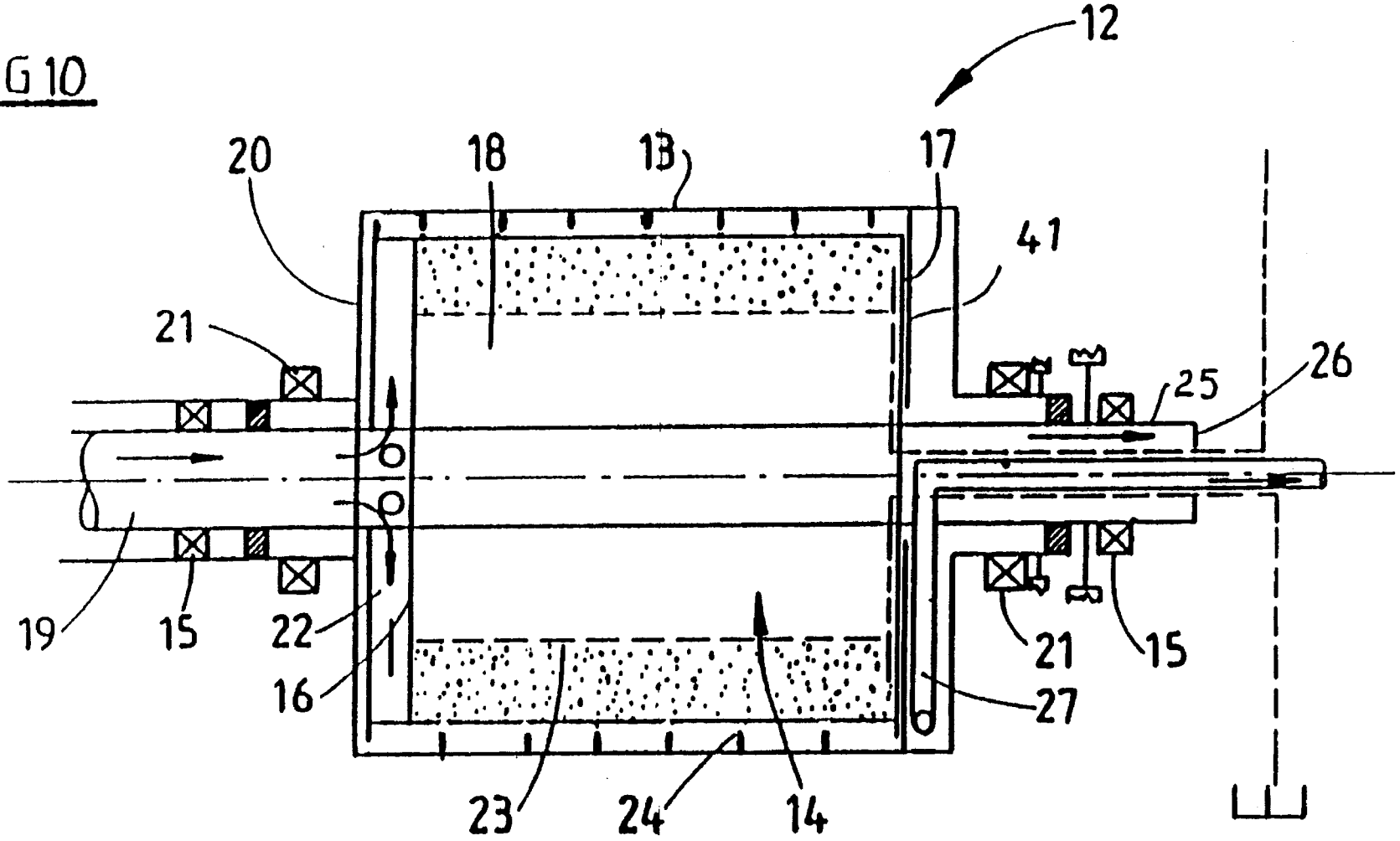
FIG. 10 illustrates the rotor of FIG. 6 except that the ribbon scroll is attached to the main body.

An apparatus or a thickener according to one embodiment of the present invention is illustrated in FIGS. 5 to 7. The apparatus (12) comprises a barrel (13) which is as shown cylindrical in shape, but could be any suitable shape such as frustoconical, and is supported on bearings (21).

A rotor (14) is supported on bearings (15) for rotation within the barrel (13), and is as shown in FIGS. 5 and 6.

The rotor (14) rotates at a slightly different RPM to that of the barrel (13). A differential of one RPM could be adequate.

The rotor (14) comprises two radially extending end walls or discs, the first being a feed disc (16) and the second the discharge disc (17). Joining the two discs (16) and (17) are a plurality of radial blades (18) which can extend from the periphery of the discs (16) and (17) to the axis of rotation. Preferably a clearance is provided between the blades (18) near the axis of rotation to provide a common path for the discharge of the centrate. The blades (18) provide individual chambers in which settlement under increased centrifugal gravity will take place with minimized effects of rotational shear. The aforementioned clearance permits the centrate to move radially inwardly through the chambers in a direction toward the axis of rotation where the centrate is discharged.

The feed is fed through a central feed pipe (19) into a chamber formed by the feed disc (16) and the end wall (20) of the barrel (13). Vanes (22) extend radially from the feed pipe (19). The feed disc (16) has a clearance at its periphery from the barrel (13) whereby the feed enters the "thickening chamber" containing the blades (18). The dimensions of the disc (16) and vanes (22) are chosen so as to minimized shear being imported to the agglomerating feed.

In the thickening chamber a sludge blanket (23) is formed by the solids being compacted by the centrifugal force against the periphery of the chamber with the liquor or centrate percolating towards the axis of rotation.

Figure 1:
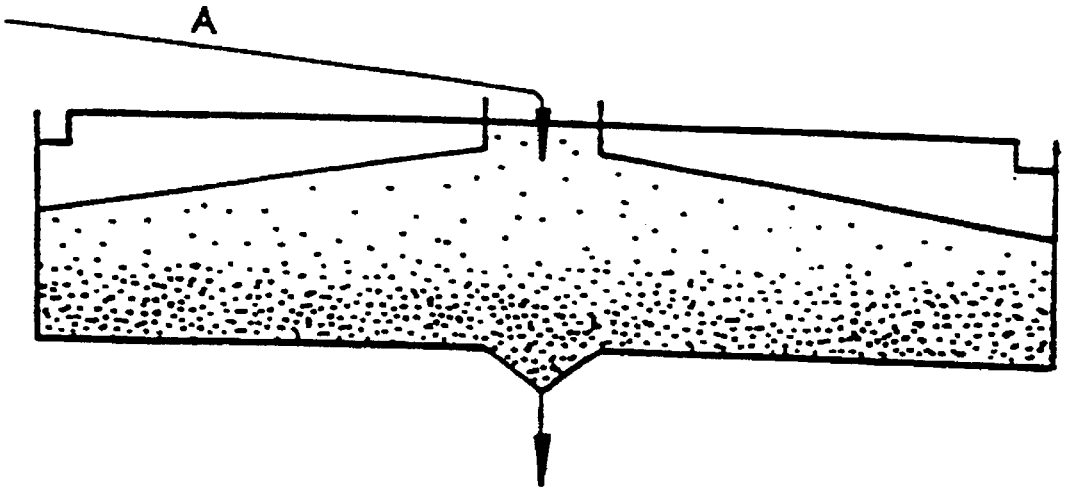
FIG 1 (PRIOR ART)
FIG. 1 is a schematic view of a conventional thickener tank.
Figure 2:
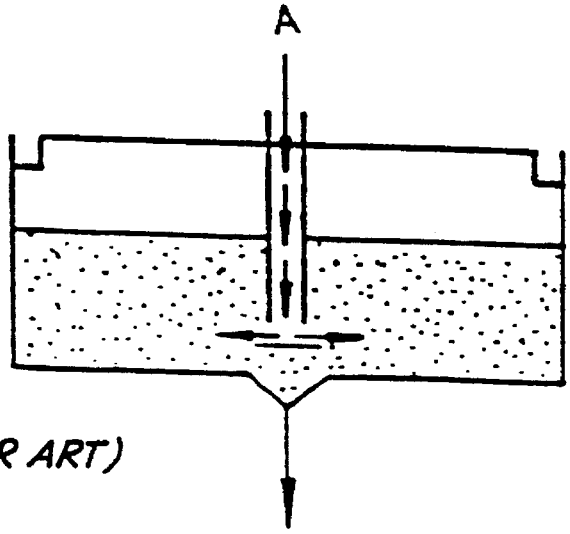
FIG. 2 is a schematic view of a modified form of the conventional tank.
Figure 3:
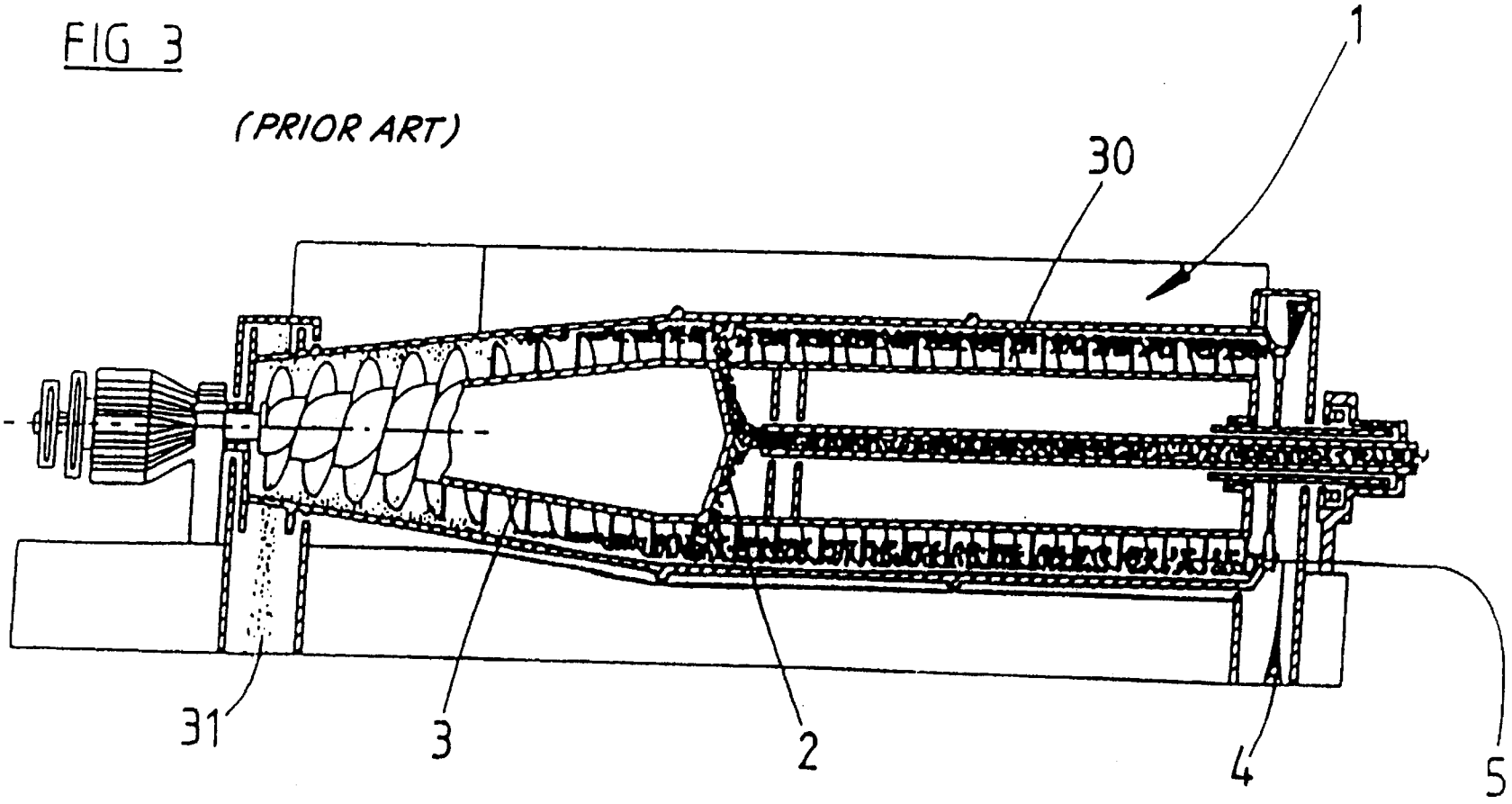
FIG 3 (PRIOR ART)
FIG. 3 is a schematic view of a conventional centrifuge.

Transfer means in the form of a generally helical ribbon scroll (24) or band is connected to the outer diameter of the radial blades (18). The narrow ribbon scroll (24) being helical continuously moves along the bottom of the bed of settling solids, ensuring the movement of both coarse particles and slurry towards the discharge end, with minimal shear. This feature differs significantly from conventional centrifuges as shown in FIG. 3, where a full depth scroll (30) pushes all settled material to the solids discharge (31) and hence produces a high degree of shear to those agglomerated particles. The heavier component of the material is discharged through a clearance at the periphery of disc 17.

The apparatus may further include a discharge orifice 40 formed in a partition wall 41 which is in the form of a plate and is for rotation with the barrel 13. The partition wall 41 is disposed between end wall or discharge disc 17 and the discharge pipe 27 which is described in more detail hereinafter. The discharge orifice is located at the periphery of the partition wall 41 and is adapted to rotate relative to the rotor 14 as a result of relative rotation between the barrel 13 and rotor 14. The partition wall 41 includes a central opening 43 through which the central part of the rotor 14 passes. Mounting flanges 45 are provided on the periphery of the wall to permit it to be bolted to the barrel 13. The relative rotation between the discharge orifice 40 and the discharge pipe 27 permits a balanced discharge from each of the sub-chambers.

The above combination of features of the embodiments of the present invention, together with the flow of solids and liquor being co-current rather than counter-current as in many conventional centrifuges ensures minimum shear and disturbance to the settling of the solids.

The centrate or lighter component is discharged through the hollow shaft (25) of the rotor (14). A circular weir (26) can be installed at the discharge point.

As shown in FIGS. 5 to 7, the apparatus is set up to discharge the heavier component in a slurry form. A discharge pipe (27) is located beyond the discharge disc (17) and extends to the axis of the rotor for rotation therewith and along the axis of rotation past the central discharge point to a rotating joint and thence to discharge via a variable speed positive displacement pump if required. In another arrangement air may be fed into pipe (27) externally of the apparatus to assist in freer flow.

If the apparatus is used to discharge solids cake, a conical scroll discharge similar in principle to the existing centrifuge designs (see FIG. 3) would be required.

The scroll would extend from the discharge disc, collecting the solids from the ribbon scroll. The conical scroll would continue as a deeper ribbon scroll so as to allow low density slurry to flow back down the conical scroll into the region of high centrifugal force settling.

As shown, two sampling tubes (28) and (29) can be provided as part of the rotor (14) to monitor the sludge blanket level within the thickener (12). The tubes (28) and (29) would be passed through the rotor discharge disc (17) to external sampling collection stations.

The orientation of the apparatus is not critical, and as such the axis of rotation may be horizontal, vertical or at an angle.

Variations and modifications can be made to the above described apparatus without departing from the scope and spirit of the present invention.

I claim:

1. Apparatus for separating materials into a heavier component and a lighter component comprising:

a main body;

a rotor disposed within said main body, said rotor and said main body being rotatable about axes of rotation; said rotor comprising:

first and second end walls spaced apart from one another with a rotor chamber therebetween, and a plurality of generally radially extending blades extending between said first and second end walls and separating said rotor chamber into a plurality of sub-chambers;

a feed inlet chamber between said main body and said first end wall;

said first and second end walls having a circumferential clearance for permitting the flow of material into and the discharge of the heavier component out of the rotor chamber; and a generally centrally disposed discharge in communication with the rotor chamber for discharging the lighter component from a radially inner portion of the rotor chamber, said sub-chambers being open in a radially inward direction with respect to the rotor's axis of rotation and being arranged with respect to said centrally disposed discharge so that said lighter component flows in said radially inward direction through said sub-chambers and directly into said centrally disposed discharge.

2. The apparatus according to claim 1 including transfer means for enabling flow of material through the rotor chamber.

3. The apparatus according to claim 2 wherein said rotor and said main body are caused to rotate at different speeds and said transfer means comprises a generally helically or spirally shaped strip operatively connected to either the rotor body so that relative rotation between the rotor and main body causes transfer of the material by the strip through the rotor chamber.

4. The apparatus according to claim 2, wherein said rotor and said main body are caused to rotate at different speeds and said transfer means is connected to the rotor so that relative rotation between the rotor and the main body causes transfer of the material through the rotor chamber.

5. The apparatus according to claim 1 wherein the flow of the lighter and heavier components is co-current.

6. The apparatus according to claim 1 wherein said main body comprises a generally cylindrically shaped member mounted for rotation with said rotor being co-axially disposed therein and capable of relative rotation thereto.

7. The apparatus according to claim 1 further including a feed inlet for delivering material to said feed inlet chamber said feed inlet being centrally disposed with respect to the feed inlet chamber.

8. The apparatus according to claim 1 wherein said feed inlet chamber includes a plurality of generally radially extending blades therein mounted for rotation within said feed inlet chamber.

9. The apparatus according to claim 1 further including an outlet chamber between said second end wall of said rotor and said main body and a discharge outlet pipe having an open end thereof disposed towards the periphery of said outlet chamber for discharging the heavier component from the apparatus.

10. The apparatus according to claim 9 further including a discharge orifice in a partition wall disposed within said outlet chamber between said second end wall and said discharge outlet pipe, said partition wall being mounted for rotation with said main body.

11. A method of separating material into a heavier component and a lighter component, the method comprising the steps of:

feeding material to a rotatable rotor which forms a series of sub-chambers which are open in a radially inward direction with respect to a rotation axis of said rotatable rotor;

causing rotation of the rotor to separate material within the sub-chambers into lighter and heavier components in such a way that the lighter components flow through said sub-chambers in said radially inward direction directly toward a generally centrally disposed discharge;

transferring the heavier component through the sub-chambers from an inlet end to an outlet end; and discharging the lighter and heavier components from the sub-chambers.

12. An apparatus for separating materials into a heavier component and a lighter component comprising:

a main body;

a rotor disposed within said main body, said rotor and said main body being rotatable about axes of rotation; said rotor comprising:

first and second end walls spaced apart from one another with a rotor chamber therebetween, and a plurality of generally radially extending blades extending between said first and second end walls and separating said rotor chamber into a plurality of sub-chambers;

a feed inlet chamber between said main body and said first end wall;

said first and second end walls having a circumferential clearance for permitting the flow of material into and the discharge of the heavier component out of the rotor chamber; and a generally centrally disposed discharge in communication with the rotor chamber for discharging the lighter component from the rotor chamber;

an outlet chamber between said second end wall of said rotor and said main body and a discharge outlet pipe having an open end thereof disposed towards the periphery of said outlet chamber for discharging the heavier component from the apparatus; and a discharge orifice in a partition wall disposed within said outlet chamber between said second end wall and said discharge outlet pipe, said partition wall being mounted for rotation with said main body.

* * * * *